US009689248B2

(12) United States Patent
Thiessen

(10) Patent No.: US 9,689,248 B2
(45) Date of Patent: Jun. 27, 2017

(54) DUAL TANK STRUCTURE INTEGRALLY SUPPORTED ON A PORTABLE BASE FRAME

(71) Applicant: Lester James Thiessen, Neilburg (CA)

(72) Inventor: Lester James Thiessen, Neilburg (CA)

(73) Assignee: BDC CAPITAL INC., Calgary, Alberta (CA)

( * ) Notice: Subject to any disclaimer, the term of this patent is extended or adjusted under 35 U.S.C. 154(b) by 876 days.

(21) Appl. No.: 14/021,289

(22) Filed: Sep. 9, 2013

(65) Prior Publication Data

US 2014/0096832 A1 Apr. 10, 2014

Related U.S. Application Data

(63) Continuation-in-part of application No. 13/645,924, filed on Oct. 5, 2012.

(60) Provisional application No. 61/684,400, filed on Aug. 17, 2012.

(51) Int. Cl.

| | |
|---|---|
| ***E21B 43/00*** | (2006.01) |
| ***E21B 43/34*** | (2006.01) |
| ***B65D 88/02*** | (2006.01) |
| ***B65D 88/12*** | (2006.01) |
| ***B65D 90/16*** | (2006.01) |
| ***B65D 88/74*** | (2006.01) |
| ***B65D 90/00*** | (2006.01) |
| ***B65D 90/24*** | (2006.01) |

(52) U.S. Cl.

CPC ..... *E21B 43/34* (2013.01); *B65D 88/027* (2013.01); *B65D 88/128* (2013.01); *B65D 88/129* (2013.01); *B65D 88/744* (2013.01); *B65D 90/0066* (2013.01); *B65D 90/0093* (2013.01); *B65D 90/16* (2013.01); *B65D 90/24* (2013.01); *B65D 2590/0091* (2013.01); *Y10T 137/0318* (2015.04); *Y10T 137/86196* (2015.04); *Y10T 137/86276* (2015.04); *Y10T 137/86292* (2015.04); *Y10T 137/86348* (2015.04)

(58) Field of Classification Search

CPC ..... E21B 43/34; B65D 88/128; B65D 88/129; Y10T 137/86187; Y10T 137/86196; Y10T 137/86276; Y10T 137/86292

USPC ..... 166/266, 267; 141/231; 137/127, 263, 137/572; 410/26

See application file for complete search history.

(56) References Cited

U.S. PATENT DOCUMENTS 3,807,433 A * 4/1974 Byrd ..... B67D 7/0476 137/255
4,000,789 A * 1/1977 Zahner ..... E04G 1/34 182/145

(Continued)

*Primary Examiner* — Timothy L Maust
(74) *Attorney, Agent, or Firm* — Ryan W. Dupuis; Kyle R. Satterthwaite; Ade & Company Inc.

(57) ABSTRACT

A dual tank structure includes first and second tanks with a common secondary containment structure which are all integrally supported on a common base frame. The common base frame includes longitudinal skids so as to be suitable for transport using a conventional winch truck. A passageway with an integral valve therein permits selective communication between the tanks. The common containment structure has a containment volume which is greater than a storage volume of a largest one of the first tank and the second tank and which is less than a combined storage volume of both the first tank and the second tank.

17 Claims, 8 Drawing Sheets

(56) References Cited

U.S. PATENT DOCUMENTS

| | | | | | |
|---|---|---|---|---|---|
| 4,007,766 | A * | 2/1977 | Hurst | B65D 88/544 | 141/198 |
| 4,422,485 | A * | 12/1983 | O'Shea | B67D 7/00 | 105/241.1 |
| 4,960,222 | A | 10/1990 | Fields | | |
| 5,071,166 | A | 12/1991 | Marino | | |
| 5,082,034 | A * | 1/1992 | Soper | B67D 7/78 | 137/264 |
| 5,392,911 | A | 2/1995 | Gillispie et al. | | |
| 5,603,360 | A * | 2/1997 | Teel | F17C 5/06 | 137/267 |
| 5,752,617 | A * | 5/1998 | Yung | B65D 90/24 | 220/4.12 |
| 6,014,995 | A * | 1/2000 | Agnew | B60P 3/2245 | 137/208 |
| 6,578,634 | B2 * | 6/2003 | Newman | E21B 47/00 | 166/250.01 |
| 8,579,332 | B2 * | 11/2013 | Sonderegger | B60K 15/03 | 123/514 |

* cited by examiner

DUAL TANK STRUCTURE INTEGRALLY SUPPORTED ON A PORTABLE BASE FRAME

This application is a continuation-in-part of U.S. parent application Ser. No. 13/645,924, filed Oct. 5, 2012, and claims the benefit under 35 U.S.C. 119(e) of U.S. provisional application Ser. No. 61/684,400, filed Aug. 17, 2012.

FIELD OF THE INVENTION

The present invention relates to a tank structure including first and second tanks integrally supported on a common skid base for ready transport to and from a hydrocarbon production well, and more particularly the present invention relates to a common skid base supporting first and second tanks thereon together with an integral secondary containment structure. The dual tank structure can be used for storing produced hydrocarbons at a well site in which produced fluids are initially directed to the first tank and then a treated portion of produced hydrocarbons in the first tank can be transferred to the second tank.

BACKGROUND

In the oilfield industry, portable tanks have many uses, including receiving produced fluids from a hydrocarbon well. In this instance, it is known to produce the fluids directly into a first tank on site. Some separation of the initially produced fluids can occur in the first tank such that sand and heavier solids remain in the first tank while lighter hydrocarbons are transferred to a second tank located at the second site also. In this instance, each tank requires secondary containment which is commonly provided by a complex and time consuming assembly of a barrier or dike system about the tanks to support a membrane thereacross upon which the tanks are supported. The containment volumes of the membranes draped over the perimeter barriers are greater than the storage volumes of the tanks.

In some instances, it is known to provide a storage tank in a portable configuration on a skid base as disclosed in U.S. Pat. No. 5,392,911 by Gillispie et al. and U.S. Pat. No. 4,960,222 by Fields. Each tank requires its own integral containment having a containment volume at least the size of the tank such that the containment portion represents a considerable portion of the material and manufacturing cost of the overall tank structure. In the instance that any treatment is performed on site to separate some of the lighter hydrocarbons, a second tank assembly is required with its own containment structure.

SUMMARY OF THE INVENTION

According to one aspect of the present invention there is provided a dual tank structure comprising:

a base frame which is elongate in a longitudinal direction and which includes at least two beams extending in the longitudinal direction along a bottom side so as to be arranged to facilitate handling and transport of the dual tank structure;

a first tank integrally supported on the base frame; and a second tank integrally supported on the base frame.

Preferably the first and second tanks are horizontally supported on the base frame so as to be elongate in the longitudinal direction of the base frame and so as to be end to end in series with one another.

Preferably a common containment structure is integrally supported on the base frame and spanning below both the first and second tanks.

According to a further aspect of the invention there is provided a dual tank structure comprising:

a base frame which is elongate in a longitudinal direction and which includes at least two beams extending in the longitudinal direction along a bottom side so as to be arranged to facilitate handling and transport of the dual tank structure;

a first tank integrally supported on the base frame;

a second tank integrally supported on the base frame; and a common containment structure integrally supported on the base frame and spanning below both the first and second tanks;

the common containment structure having a containment volume which is greater than a storage volume of a largest one of the first tank and the second tank and which is less than a combined storage volume of both the first tank and the second tank.

By providing dual tanks with integral containment commonly supported on a single base, a single unit can be delivered to a well site with one truck while providing the function of a first tank for receiving initially produced fluids and a second tank for receiving a second lighter portion of hydrocarbons therein. Also, the containment is only required to exceed the largest of the two tanks by 10% such that when integrally supported with two tanks on a common base, the overall containment volume of the containment structure is permitted to be far less than the combination of the storage volumes of the two tanks. Accordingly, adequate containment for two tanks is provided with minimum manufacturing costs and material costs associated with the containment structure. Even if both tanks are used for common fluid storage, the containment mass and manufacturing costs are considerably reduced as compared to a comparable sized single tank.

Preferably the containment volume is approximately 110% to 120% of the storage volume of the largest one of the first tank and the second tank.

The dual tank structure may be used in combination with a winch truck including a deck and a winch for winching an object onto the deck in which the base frame of the dual tank structure includes an anchor arranged for connection to the winch and the beams of the base frame of the dual tank structure are arranged to be supported on the deck of the winch truck.

The base frame may include a floor panel spanning in the longitudinal direction in which the containment structure comprises a plurality of side walls extending upwardly from the floor panel partway up a height of the first and second tanks to an open top end of the containment volume.

Preferably the first and second tanks are elongate in the longitudinal direction and are mounted on the base frame end to end in series with one another.

There may be provided a continuous cylindrical tank wall supported on the base frame, in which case a divider member is preferably supported in the continuous cylindrical tank wall to define the first tank and the second tank on opposing sides of the divider member within the continuous cylindrical tank wall. The divider member may comprise an assembly of a first wall and a second wall joined to the continuous cylindrical tank wall to define inner ends of the first tank and the second tank respectively.

Preferably there is provided a passageway communicating between the first tank adjacent a top end of the first tank and the second tank. More particularly, there may be provided a riser supported in the first tank having an open top end in communication with an interior of the first tank adjacent the top end of the first tank such that the remaining portion of the passageway communicates between a bottom end of the riser in the first tank and the second tank.

Preferably there is further provided a shut-off valve in series with the passageway including an actuator member supported externally of the first and second tanks for operating the valve between respective open and closed positions.

When a first end of the base frame protrudes longitudinally outward beyond the first and second tanks, there may be provided an enclosure on the base frame between the first end of the base frame and the first tank and a plurality of valves within the enclosure in communication with the first tank. The valves may include a wash valve in communication with a wash line extending into the first tank and supporting wash nozzles thereon and a drain valve in communication with the first tank adjacent the bottom end thereof.

Similarly, when a second end of the base frame protrudes longitudinally outward beyond the first and second tanks, there may be provided an enclosure on the base frame between the second end of the base frame and the second tank and a plurality of valves within the enclosure in communication with the second tank.

There may also be provided a fire tube extending through the first tank or both the first and second tanks in communication between a burner fitting at one end of the fire tube and an exhaust stack at the other end of the fire tube.

The base frame may further comprise a rectangular floor panel spanning horizontally in the longitudinal direction which is supported on the beams which extend along a bottom side of the floor panel such that a plurality of side walls of the secondary containment structure extend upwardly from each side of the floor panel about a full perimeter of the floor panel partway up a height of the first and second tanks to an open top end of the containment volume. In this instance the base frame may yet further comprise a plurality of longitudinally spaced apart tank supports in which each tank support is joined at a bottom side to the floor panel, joined at outer sides to respective side walls of the containment structure, and joined at a top side to the continuous cylindrical tank wall.

Preferably there is provided at least one suction tube extending between an open bottom end in communication with the containment structure adjacent a bottom end thereof and an opposing end having a tubing connector thereon for selective connection to a suction pump. Preferably the bottom end of said at least one suction tube is received within a sump area recessed below the floor of the containment structure.

Preferably at least one of the tanks comprises a perimeter door frame about an inlet door opening at one end thereof and a door which is movable between a closed position in sealed connection with the perimeter door frame and an open position in which the inlet door opening is substantially unobstructed by the door. Preferably the perimeter door frame includes a door sill which is recessed below a tank floor defining a bottom end of the tank.

One or both tanks may be provided with a user a support structure supported on the tank which comprises: i) a platform structure supported above the tanks for supporting a person thereon in proximity to a hatch opening on a top side of one of the tanks; ii) a ladder structure extending downwardly from the platform for providing access to the platform; and iii) a railing structure extending upwardly from at least one side of the platform structure. Preferably at least one of the platform structure, the ladder structure and the railing structure are foldable from a working position to a transport position in which an overall height of the support structure is reduced relative to the working position. More preferably, the railing structure is foldable relative to the platform structure from the working position to the transport position to reduce the overall height of the support structure.

A portable ladder structure may be provided which comprises an upper hook portion arranged to be hooked overtop of a top end of one of the side wall and a depending ladder portion having a plurality of vertically spaced apart rungs formed thereon in which the upper hook portion is arranged to be releasably hooked onto the side wall in a first orientation in which the ladder portion extends along an inner side of the side wall and a second orientation in which the ladder portion extends along an outer side of the side wall.

Preferably the dual tank structure includes a production inlet in communication with the first tank so as to be arranged to received produced fluids from a well therethrough, a passageway communicating between the first tank and the second tank so as to be arranged to transfer produced fluids from the first tank to the second tank therethrough, and a delivery outlet arranged to delivery produced fluids therethrough from the second tank to an external tank structure. Preferably the production inlet, the passageway and the delivery outlet are all supported within a perimeter of the containment structure.

When one or both of the first and second tanks further comprises an enclosure supported adjacent to the tank which locates a plurality of access ports therein in communication with an interior of the tank at different elevations, preferably the enclosure is supported within a perimeter of the containment structure. Preferably the enclosures are located adjacent respective inner ends of the tanks such that the enclosures are adjacent one another.

There may be provided a platform structure mounted on the base frame in proximity to the delivery outlet for pivotal movement between a working position in which the platform is horizontally oriented for supporting a user thereon and a stored position in which the platform is oriented in an upright orientation.

The dual tank structure may further include a wash assembly comprising: i) a plurality of wash nozzles supported within the first tank; ii) a supply connection in communication with the wash nozzles for supplying wash fluid therethrough; and iii) a drain connection in communication with the first tank for draining contents of the first tank therethrough, in which the supply connection and the drain connection are supported within a perimeter of the containment structure.

When a fire tube opening is located in an end wall of at least one of the first and second tanks, preferably a fire tube assembly arranged to be supported in the fire tube opening which comprises: i) a mounting panel arranged to span the fire tube opening be selectively mounted in sealing engagement about a perimeter of the fire tube opening using threaded fasteners; ii) a burner fitting in communication through the mounting panel; iii) an exhaust stank in communication through the mounting panel separately from the burning fitting; and iv) a fire tube having an intermediate portion arranged to extend into the tank in communication between the burner fitting at one end of the fire tube and the exhaust stack at the other end of the fire tube.

When an access door is provided in a side wall of at least one of the tanks, preferably an auxiliary door is located in a corresponding side wall of the containment structure in alignment with said access door so as to be arranged to receive a stinger rod therethrough.

According to another aspect of the present invention there is provided a method of storing produced hydrocarbons from a well at a well site, the method comprising:

delivering a dual tank structure to the well site in which the dual tank structure comprises: (i) an elongate base frame which is elongate in a longitudinal direction and which includes at least two beams extending in the longitudinal direction along a bottom side so as to be arranged to facilitate handling and transport of the dual tank structure; (ii) a first tank integrally supported on the base frame; (iii) a second tank integrally supported on the base frame; (iv) a production inlet in communication with the first tank; (v) a passageway communicating between the first tank and the second tank; and (vi) a delivery outlet in communication with the second tank;

directing the produced hydrocarbons directly from the well into the first tank through the production inlet;

transferring a portion of the produced hydrocarbons from the first tank to the second tank through the passageway; and arranging the produced fluids to be delivered from the second tank through the delivery outlet.

Preferably the dual tank structure is delivered with a common containment structure integrally supported on the base frame and spanning below both the first and second tanks prior to delivering the dual tank structure to the well site.

Preferably the method includes drawing the portion of the produced hydrocarbons from the first tank from a location adjacent a top end of the first tank such that said portion comprises a lighter portion of the hydrocarbons.

According to yet another aspect of the present invention there is provided a method of storing produced hydrocarbons from a well, the method comprising:

providing a dual tank structure comprising:

a base frame which is elongate in a longitudinal direction and which includes at least two beams extending in the longitudinal direction along a bottom side so as to be arranged to facilitate handling and transport of the dual tank structure;

a first tank integrally supported on the base frame;

a second tank integrally supported on the base frame; and a common containment structure integrally supported on the base frame and spanning below both the first and second tanks in which the common containment structure has a containment volume which is greater than a storage volume of a largest one of the first tank and the second tank and which is less than a combined storage volume of both the first tank and the second tank;

directing the produced hydrocarbons directly from the well into the first tank; and transferring a lighter portion of the produced hydrocarbons from the first tank to the second tank integrally supported together on the base frame with the first tank.

The lighter portion of the produced hydrocarbons is preferably drawn from the first tank at a location adjacent a top end of the first tank.

Various embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
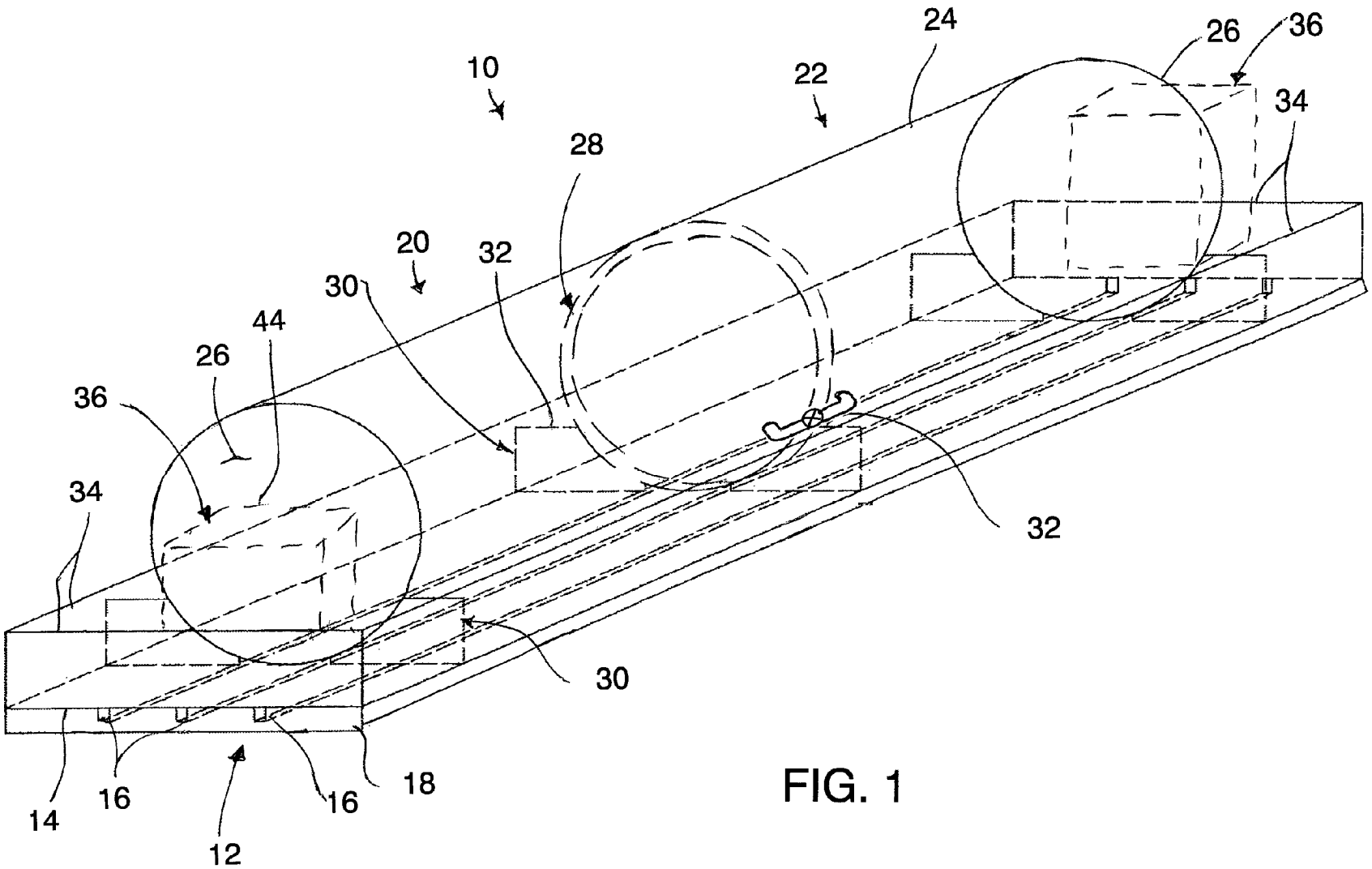
FIG. 1 is a schematic perspective view of a first embodiment of the dual tank structure.

Referring to the accompanying figures, there is illustrated a dual tank structure generally indicated by reference numeral 10. The tank structure is particularly suited for ready transport to various oilfield sites for storing various fluids therein without the requirement of a secondary containment structure being separately transported and assembled as secondary containment is integrally incorporated into the dual tank structure.

Although various embodiments are illustrated in the accompanying figures, the common features of the various embodiments will first be described.

The structure 10 generally comprises a base frame 12 which is elongate in a longitudinal direction between two opposed ends of the structure. The frame includes a floor panel 14 spanning the full length in the longitudinal direction which is generally rectangular to span the full width between two longitudinally extending opposing sides of the structure. The base frame further includes a set of skid beams 16 spanning longitudinally along the bottom side of the floor panel parallel and spaced apart from one another. The skid beams each comprise a steel member for example a tubing member or an I-beam construction with suitable spacing between the beams to define a skid base which is compatible with various handling equipment for ready transport, for example for loading onto a winch truck. A cross beam 18 is provided at one or both ends of the skid beams so as to be connected between the skid beams to provide a suitable anchoring point for the winch of a winch truck.

The structure 10 further comprises a first tank 20 and a second tank 22 which are commonly and integrally supported on the base structure by welded connection.

The first and second tanks may be formed by a common cylindrical tank wall 24 having a longitudinal axis oriented in the longitudinal direction so that the tank wall forms a tank enclosure which is elongate with the base frame. End walls 26 enclose both outer ends of the cylindrical tank wall 24 and a divider member 28 spans perpendicularly to the longitudinal direction across the full cross sectional area of the tank wall at a central location between the two outer ends walls 26 so that the divider member effectively divides the common cylindrical tank wall into the first tank 20 and the second tank 22 on opposing sides thereof. More particularly, the divider member 28 is an assembly of a first wall and a second wall joined about their respective perimeters to the cylindrical wall to define the inner ends 29 of the first tank and the second tank respectively. The first and second walls are separated by a small space which is enclosed by the common cylindrical wall between the walls. The first and second tanks may thus be assembled by joining to cylindrical tanks in series with one another so that the inner end walls which are abutted and joined define the divider member.

Each resulting tank is also elongate in the longitudinal direction with the first and second tanks being positioned in series end to end abutment relative to one another. The combined length of the tanks is shorter than the overall length of the base frame such that the base frame protrudes longitudinally outward beyond the end wall 26 at the outer end of the corresponding tank wall at both ends of the tank structure. Space is thus provided between the outer end of each tank and the corresponding end of the base frame at both ends of the tank structure to accommodate various operating components as described in further detail below.

The common cylindrical tank wall is supported on the base frame by a plurality of longitudinally spaced apart tank supports 30. Each tank support defines a cradle support within which the bottom portion of the cylindrical tank wall is received and supported. The tank supports 30 are formed to allow some passage of fluids in the longitudinal direction therethrough from one end of the base frame to the other along a length of a secondary containment structure described in further detail below.

The secondary containment structure is also integrally joined to the base frame 12 to span below the first and second tanks along the full width and full length of the tanks. The containment structure comprises four side walls 34 extending upwardly from the four edges of the floor panel to define a continuous perimeter wall extending upward from the perimeter of the floor panel which functions as a bottom wall for the secondary containment structure. The side walls 34 have a height corresponding to less than half the height of the tanks to sufficiently define a containment volume which can contain the full volume of either one of the two storage tanks. As shown in the Figures, the side walls extend upwardly to respective top ends which terminate at an intermediate height of the first and second tanks so as to be spaced above a bottom end of the first and second tanks and spaced below a top end of the first and second tanks such that a top end of the common containment structure is open between the to ends of the side walls and the first and second tanks.

Typically, the first and second storage tanks are arranged to have approximately equal storage volumes. The containment volume of the secondary containment structure is generally arranged to be in the order of 110-120% of the storage volume of the largest tank such that the containment volume is much less than the combined storage volumes of the two tanks together while still meeting the regulations for secondary containment for both tanks individually and collectively when assembled integrally on a common base frame.

To provide additional support to the side walls 34 of the containment structure, additional gussets of material may be provided between the floor and the side walls. In some instances, the outermost edges of the panels 32 of each tank support can be joined to the corresponding longitudinally extending side walls along more than half the height of the wall such that the tank supports also function as gussets to reinforce the side walls of the secondary containment structure.

One or both of the tanks also includes the following operating components. Various valves 36 with corresponding fittings communicate through a respective wall of the associated tank for loading or unloading fluids from the tank as may be desired. As shown in the Figures, a fluid unloading fitting including a respective valve 36 associated therewith is provided in communication with each of the first tank and the second tank in which the fluid unloading fittings and the respective valves i) are located externally of the first and second tanks, ii) are contained laterally within the perimeter of the floor of the common containment structure, and ii) have accessible portions above a top end of the containment side walls 34. In addition to the loading lines, the tank may include an integral flushing system comprised of one or more wash lines 38 with a respective wash valve communicating through the end wall with the lines extending the length of the tank. Multi-directional nozzles are supported at longitudinal spaced positions along each wash line 38 to be directed at various angles towards a bottom and side walls of the tank for flushing sand and heavier solids from the tank at periodic times desired by the user. A drain line 48 with a corresponding drain valve communicates through the end wall adjacent the bottom end for attaching to a vacuum line to drain wash fluids and debris from the tank during a washing cycle. One or more gauges 42 may also be provided in communication through a corresponding wall of the tank for monitoring pressure within the tank.

A suitable enclosure 44 is provided about the operating components and valve connections at a location within the perimeter of the secondary containment structure. Each enclosure 44 typically comprises two spaced apart side walls 26 and a top wall 48 which is connected between the top ends of the two side walls 46 to complete the enclosure about the valves and operating components. Most of the valve components are located at a height substantially above the side wall 34 of the secondary containment structure for user access. The enclosures 44 and the tanks may be heat insulated. When the enclosure is insulated, a suitable cover member preferably encloses the user access opening of the enclosure while still permitting ready access thereto. The operating components within the enclosure are situated so as to drain into the containment volume of the secondary containment structure.

The operating components of each tank may also include a fire tube assembly 50 extending longitudinally through the interior of the first tank. Typically the fire tube of the assembly 50 is generally U-shaped between two ends communicating through an end wall at the outer end of the tank. A burner fitting is provided at one end of the fire tube and an exhaust stack communicates with the other end of the fire tube to provide heating for separating lighter hydrocarbons in at least the first tank.

In use, initially produced fluids can be placed directly into the first tank where some treatment can occur by injection of chemicals or by heating with the fire tube for example. Separated lighter portions of the produced hydrocarbons can then be transferred to the second tank by providing a suitable passageway 52 in communication between the first tank and the second tank.

The passageway includes a first portion defined by a riser tube 54 supported vertically within the first tank. The riser tube 54 includes an open top end in open communication with an interior of the first tank adjacent the top end of the first tank. The bottom end of the riser tube is connected to external piping 56 which defines a second portion of the passageway. The external piping 56 communicates between the bottom end of the riser in the first tank and an open end terminating within the interior of the second tank so as to openly communicate with the second tank adjacent the bottom end thereof.

A shut-off valve 58 is connected in series with the external piping portion of the passageway. The valve 58 includes an actuator member in connection therewith so as to be supported externally of the first and second tanks together with the operating component of the valve for operating the operating component of the valve between respective open and closed positions. The shut-off valve is operable between an open position and a closed position which permits fully closing the passageway and maintaining separation between the first and second tanks when desired. As shown in the figures, the external portion of the passageway and the shut-off valve 58 connected in series therewith is external of the first tank and the second tank and is contained within a perimeter boundary of the common containment structure while being accessible externally of the common containment structure.

Figure 2:
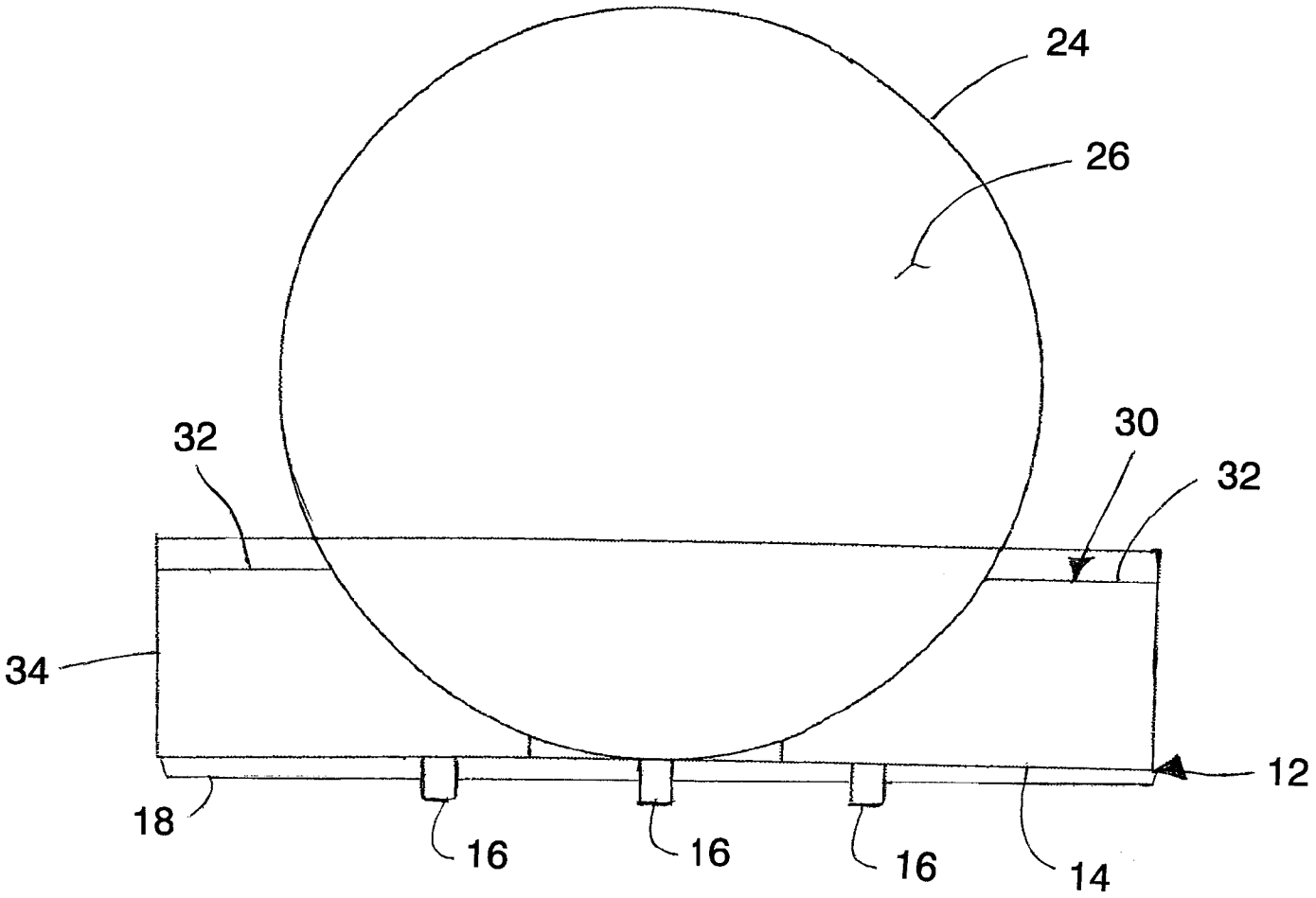
FIG. 2 is a schematic representation of an end elevational view of the tank structure according to the first embodiment of FIG. 1.
Figure 3:
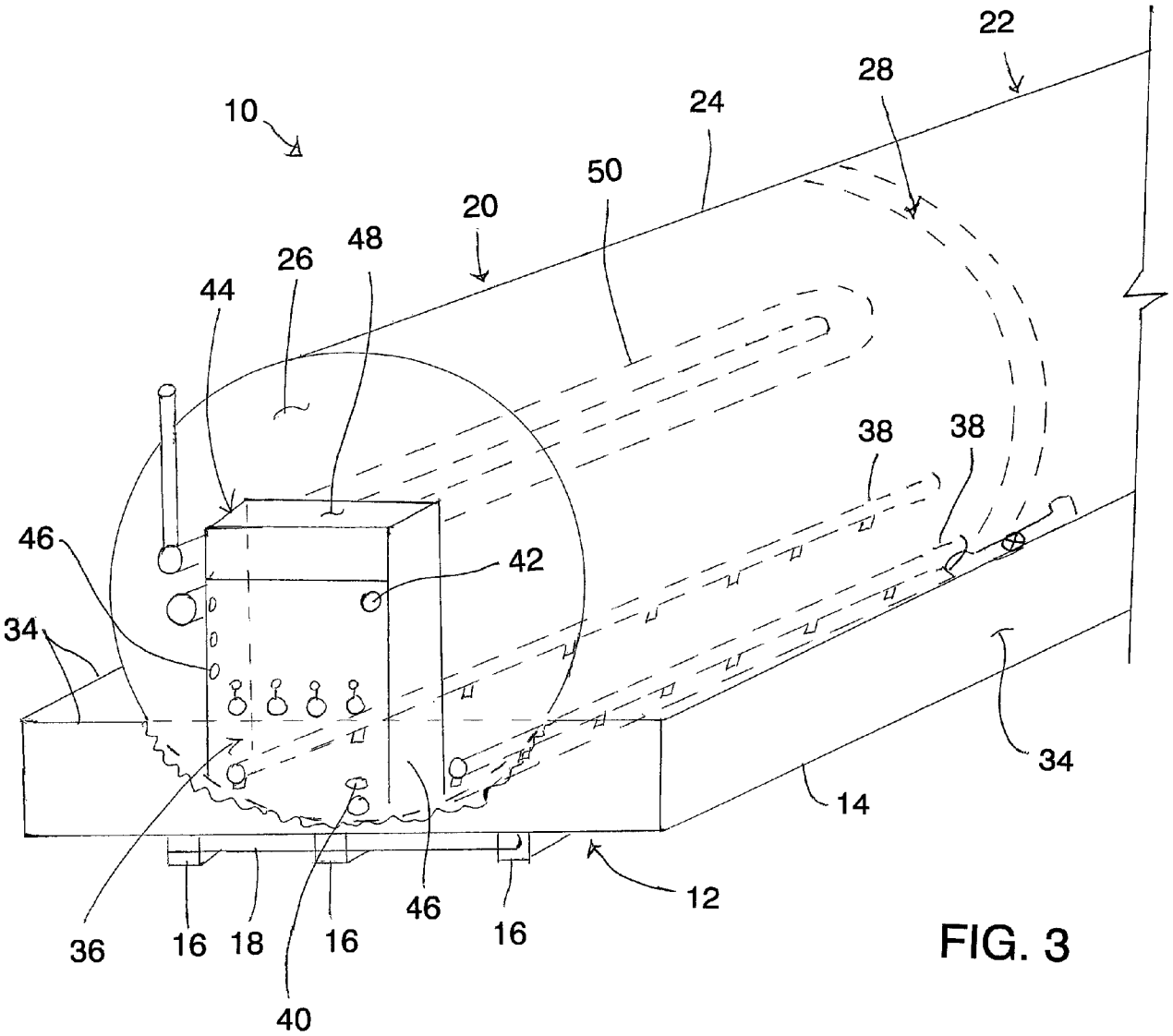
FIG. 3 is a schematic representation of various operating components associated with the tank structure according to the first embodiment of FIG. 1.
Figure 4:
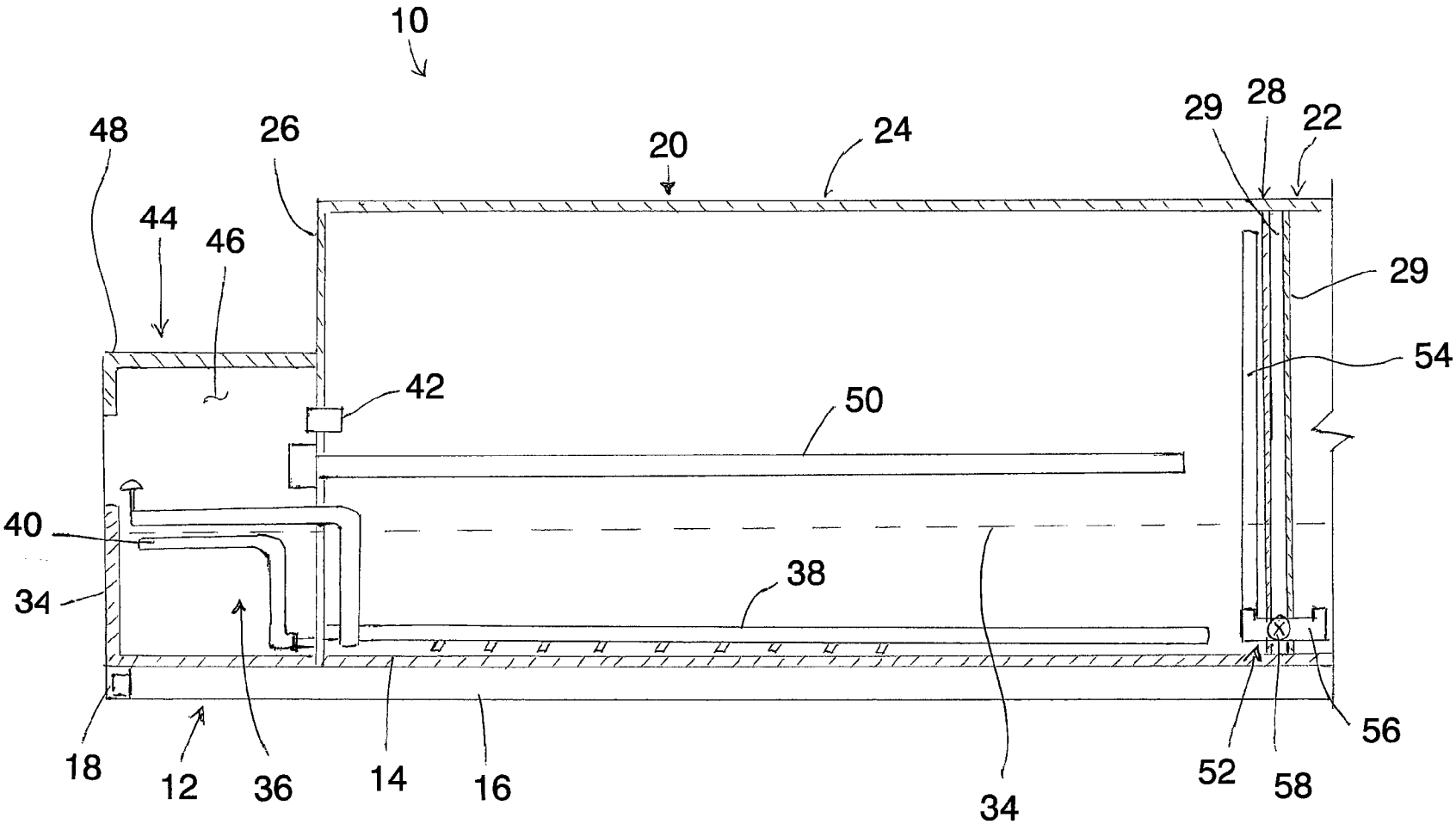
FIG. 4 is a side elevational view in partial cross section of the operating components shown in FIG. 3.

Turning now to the embodiment in FIGS. 1 through 4, the enclosure 44 is this instance is shown supported at the outer ends of the first and second tanks respectively, corresponding to longitudinally opposed ends of the base frame. The first embodiment is also distinguished from the second embodiment in that each tank support 30 is formed by two panels 32 mounted in a common vertical plane perpendicular to the longitudinal direction to define a common radius upper supporting surface upon which the cylindrical tank wall is engaged and supported. The bottom of the cylindrical tank wall directly engages the upper surface of the floor panel 14 of the base frame to provide support thereto. The two panels 32 of each tank support 30 are laterally spaced apart for engaging opposing sides of the tank wall adjacent the bottom end thereof. Each panel includes a flat bottom edge joined to the upper surface of the floor panel 14 and a curved top edge following the radius of curvature of the tank wall to be engaged in supporting relationship with the tank wall. A generally triangular gap is formed between the innermost edge of each panel and the bottom of the tank wall to provide a port for fluid to be communicated across the tank support along the full length of the containment structure in the longitudinal direction.

Figure 5:
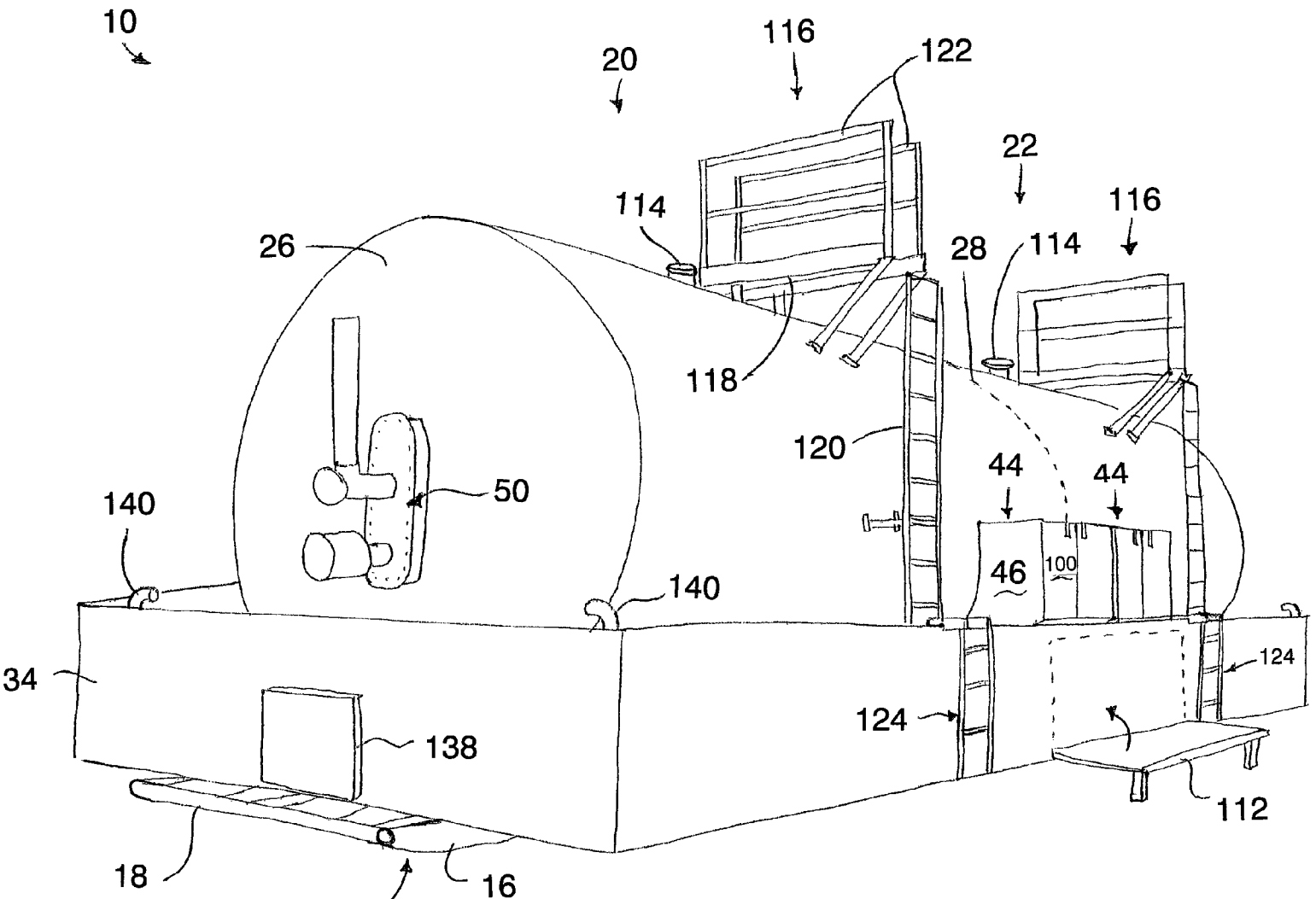
FIG. 5 is a perspective view of a second embodiment of the dual tank structure.
Figure 6:
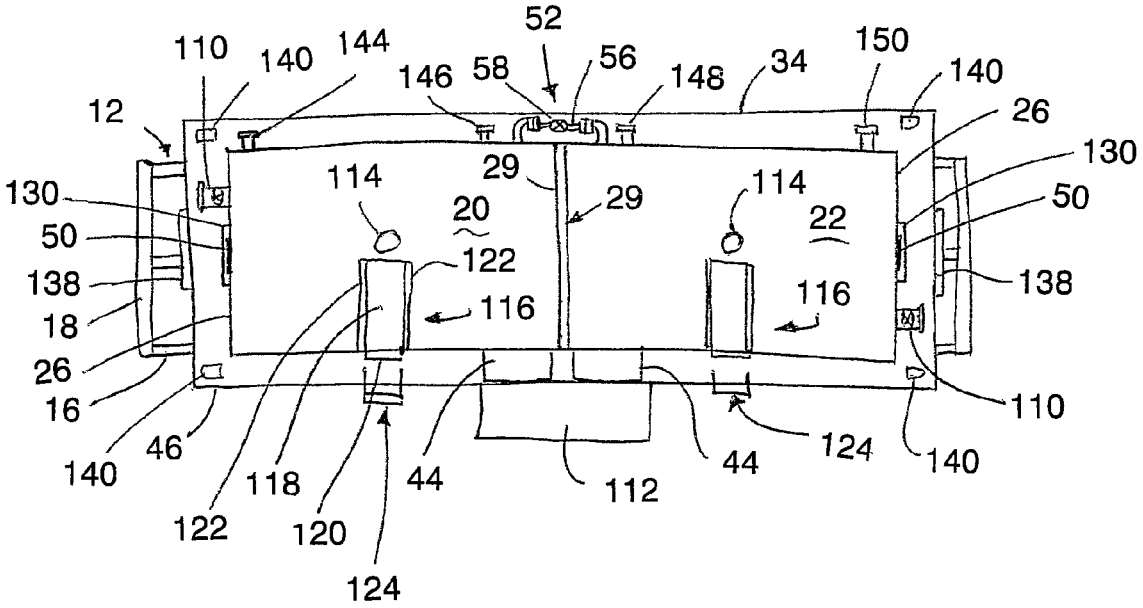
FIG. 6 is a schematic top plan view of the dual tank structure according to the second embodiment of FIG. 5.
Figure 7:
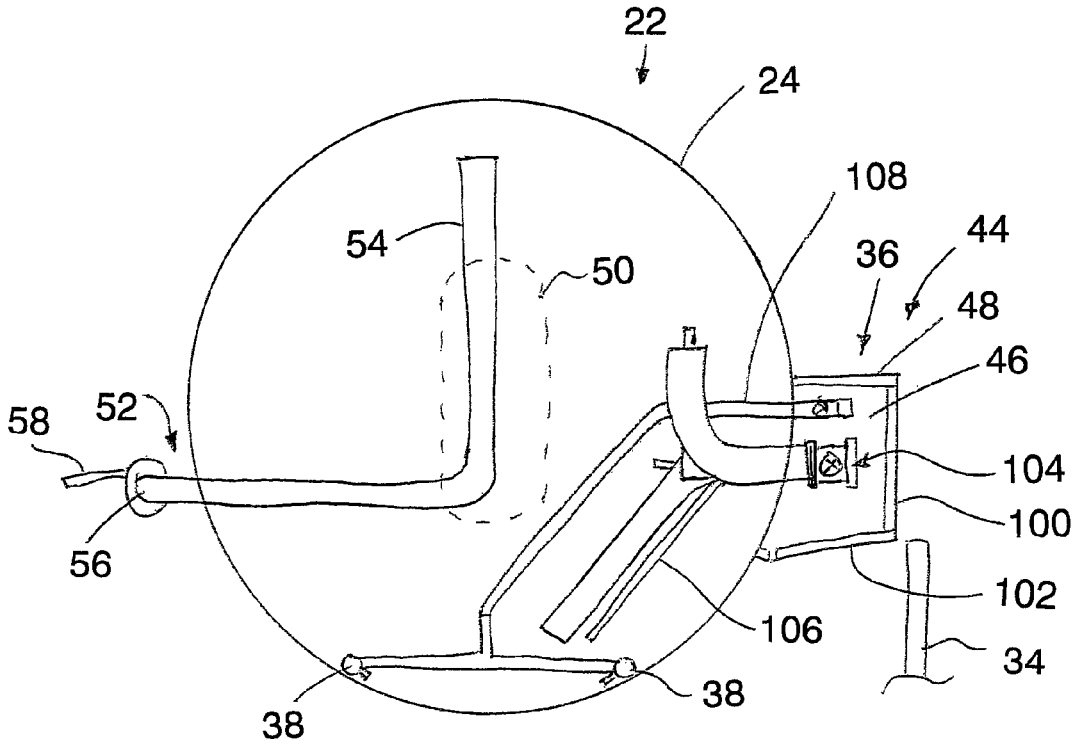
FIG. 7 is a partly sectional elevational view of the first tank according to the second embodiment of FIG. 5 in which various internal components are schematically represented.
Figure 8:
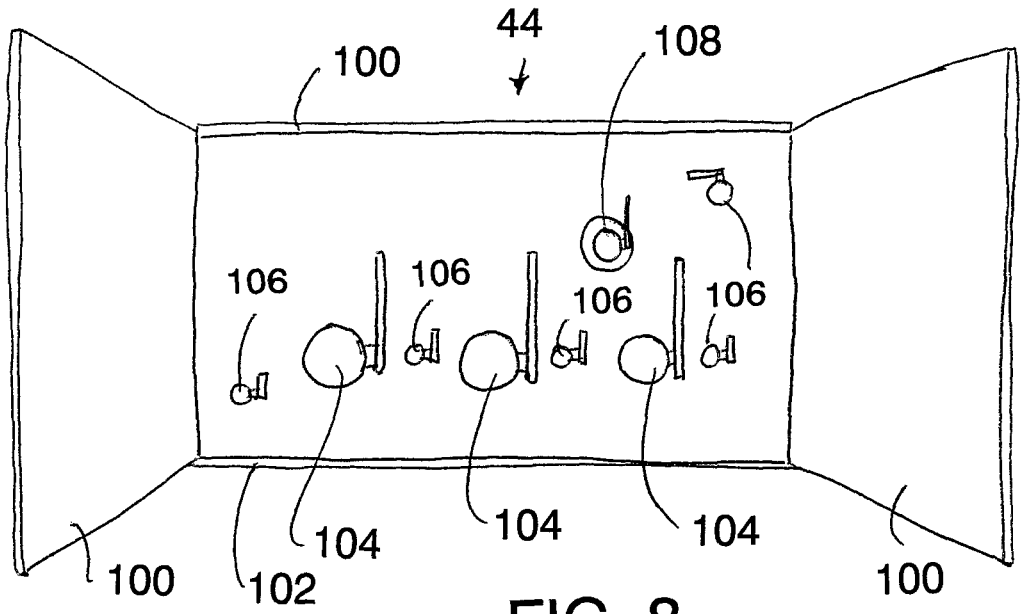
FIG. 8 is an elevational view of one of the enclosures supporting the delivery outlets of one of the tanks therein.
Figure 9:
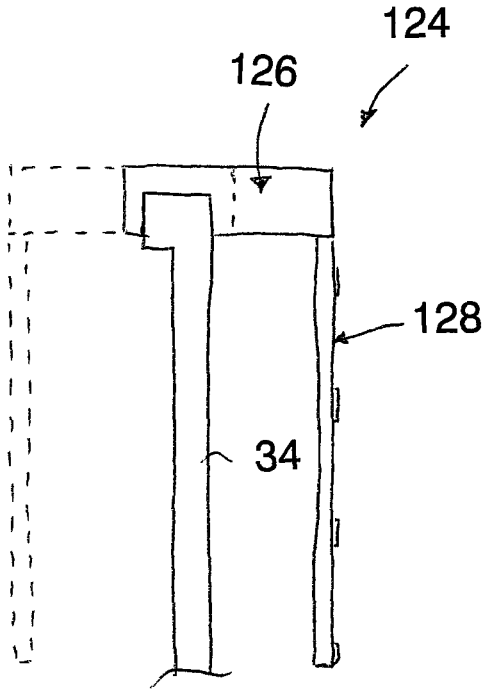
FIG. 9 is an elevational view of one of the ladder structures shown in the working position in solid line and in the stored position in broken line.
Figure 10:
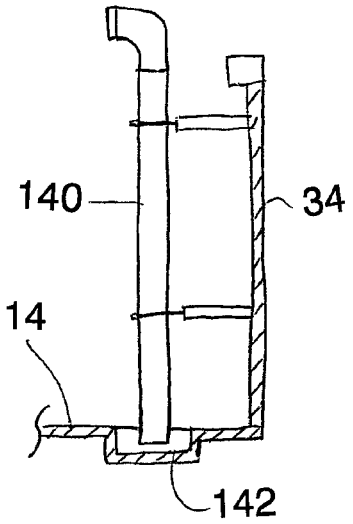
FIG. 10 is an elevational view of one of the suction tubes.
Figure 11:
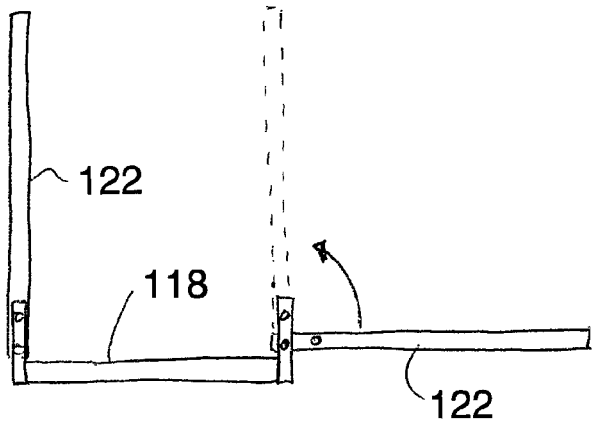
FIG. 11 is an elevational view of one of the platform portion of one of the user support structures in which one of the railing portions is shown in the working position and one of the railing portions is shown in the transport position.
Figure 12:
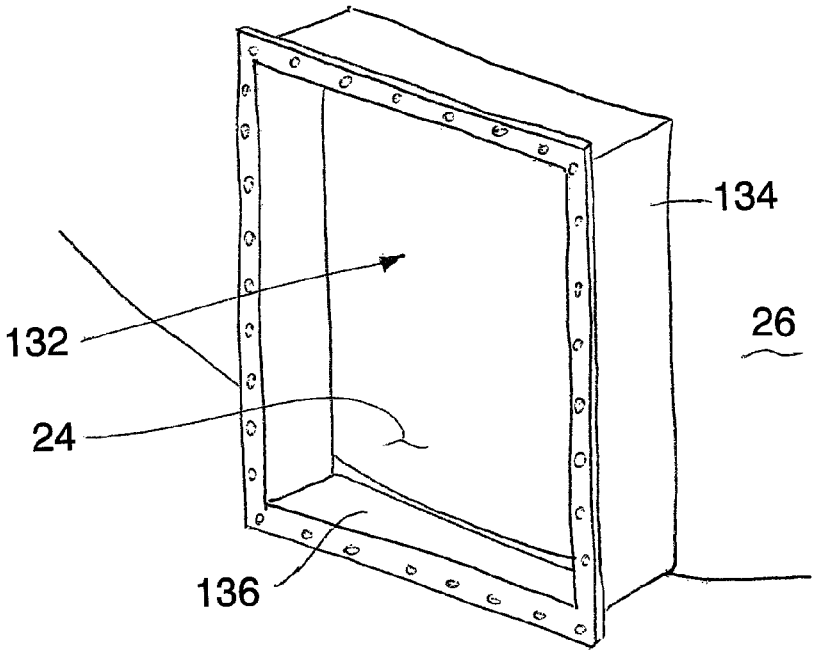
FIG. 12 is a perspective view of the perimeter door frame in the end wall of one of the tanks.

Turning now to the embodiment of FIGS. 5 through 12, in this instance the enclosures 44 locating the various valve components 36 therein for each of the first and second tanks 20 and 22 are provided adjacent to one another at an intermediate location along a longitudinal side of the structure 10 so that the two enclosures are located adjacent to one another at the inner ends of the two respective tanks while remaining within the interior of the perimeter of the secondary containment side walls.

Each enclosure 44 fully surrounds the valve components so that in addition to the side walls 46 and top wall 48, the outer sides are each enclosed by respective doors 100 pivotal between respective open and closed positions. A bottom wall 102 incorporating a drain therein encloses the bottom side with the drain positioned to drain downwardly back into the secondary containment structure. When the doors 100 are in a closed position, each enclosure is fully enclosed by the side walls, the top wall, the bottom wall and the doors while the remaining interior side is enclosed by the tank wall against which the enclosure is mounted.

The components within the interior of each enclosure include a plurality of delivery outlets 104. Each delivery outlet comprises a pipe communicating through the tank wall from an inner end in open communication with the interior of the tank to an outer end locating a valve for selectively closing the outlet and a pipe coupling for selectively connecting transfer hoses or pipes thereto for transfer to an auxiliary tank such as a delivery truck for example. In the illustrated embodiment, three delivery outlets are provided which communicate with the interior of the tank at an elevation of 14 inches, 48 inches, and 66 inches respectively.

Adjacent each delivery outlet there is provided a sampling line 106 in a form of a smaller diameter pipe which communicates through the tank wall between an inlet end in open communication with the interior of the tank and an outlet end similarly provided with a valve and coupling for selective connection to an auxiliary pipe or vessel through which contents of the tank are to be dispensed for sampling purposes. Each of the sampling lines openly communicates with the interior of the tank at the same elevation as a respective one of the delivery outlets approximately with one or more additional sampling lines provided for sampling fluid adjacent the bottom or adjacent the top of the tank.

In the second embodiment of FIGS. 5 to 12, wash lines 38 are again provided with a plurality of integral nozzles formed thereon to span longitudinally along the bottom of the tank for selectively washing the tank when supplied with wash fluid. A supply line 108 communicates through the tank wall at the enclosure from the wash lines to a supply valve and pipe coupling within the enclosure. The coupling of the supply line 108 permits a source of pressurized wash fluid to be connected to the supply line for directing wash fluid to the wash lines.

A drain outlet 110 is mounted at the outer end wall of each tank which comprises a pipe section having a valve and pipe coupling connected in series therewith through which the contents of the tank can be selectively drained, particularly when washing the tank.

User access is provided to the enclosures 44 by a platform 112 mounted to the outer side of the containment side wall 34. The platform spans a length in the longitudinal direction which is equal to the combined length of the two enclosures 44 adjacent to one another. An inner edge of the platform 112 is pivotally coupled to the side wall such that the platform is pivotal between a working position extending horizontally outward from the side wall of the containment structure and a transport position extending upward alongside the side wall in a vertical orientation. The platform is suitably sized for supporting a person thereon in the working position such that the person can readily access all of the various components within the two enclosures respectively.

Each of the tanks includes a roof access port 114 centrally located at the top side thereof to provide access into the tank therethrough or for connecting gas venting equipment or pressure relief equipment as desired The roof ports are selectively enclosed by suitable closures which can be sealed in place. To provide access to the roof ports, each tank is provided with a suitable user support structure 116 comprised generally of a platform portion 118 and a ladder portion 120.

The platform portion 118 is supported on the respective tank to extend horizontally outward from the roof port to an outer end suspended approximately above the open top end of the containment structure. The ladder portion 120 extends vertically downward from the outer end of the platform portion 118 to a bottom end positioned near in height to the top end of the side walls of the containment structure. The ladder portion comprises two side rails and a plurality of vertically spaced rungs connected therebetween.

Each support structure 116 also includes a pair of railing portions 122 which extend along the two laterally extending sides of each platform. Each railing portion is pivotal from an upright working position to a horizontal transport position relative to the respective side edge of the platform upon which it is mounted. In the working position, the railing portions are generally perpendicular to the longitudinal direction of the structure 10. Each railing portion comprises a horizontally oriented top rail spaced vertically above the platform by posts in the working position. Pins are received through cooperating apertures in the platform and the posts of the railing portion to retain each railing portion in the respective working position. For transport, the pins are removed such that the railing portions can be folded into a flat and generally coplanar relationship with the platform portion to reduce the overall height of the support structures.

Access to the ladder portions 120 of the support structure can be provided by additional portable ladder structures 124 which are selectively mounted on the side walls of the containment structure. Each ladder structure 124 comprises an upper hook portion 126 arranged to be hooked over top of the top edge of the side wall 34 and a ladder portion comprising two rails and vertically spaced rungs therebetween extending downward from the outer end of the hook portion.

The hook portion comprises two vertically oriented and spaced apart plates located at the opposing sides of the ladder structure. A recess is formed in the underside of the two plates adjacent the inner ends thereof such that the recesses mate with the profile at the top edge of the side walls for hooking onto the top edge. The ladder portion depends from the hook portion by mounting the two rails of the ladder portion to extend vertically downward from respective ones of the two plates of the hook portion.

The notch at the inner end of the hook portion is suitably shaped to be symmetrical for mounting the ladder portion in either one of two orientations corresponding to the ladder portion extending parallel to and downwardly alongside the outer side of the side wall in a first orientation, or downwardly along an inner side of the side wall in a second orientation, for example for storage or transport.

One or both tanks may be mounted with a fire tube assembly 50 as described with regard to the first embodiment. In each instance, the fire tube assembly 50 generally comprises a mounting panel 128 which has a perimeter flange arranged to be mounted about the perimeter of a fire tube opening in the end wall of the respective tank. The perimeter flange of the panel 128 can be fastened in sealing engagement with a suitable gasket and threaded fasteners to the perimeter of the fire tube opening in the end wall of the tank such that the entire fire tube assembly can be selectively removed and the fire tube opening instead enclosed by a suitable sealing panel if desired. When used, the panel of the fire tube assembly is sealed within the respective fire tube opening of the tank wall such that the burner fitting communicates through the panel adjacent the bottom end thereof and the exhaust stack communicates through the panel 128 adjacent the top end while the fire tube is generally U-shaped and extends into the tank for communication between the burner fitting at one end and the exhaust stack at the other end.

An auxiliary door 130 is provided in the outer end of each of the tanks adjacent the bottom end thereof. In this instance, the outer end walls of each tank is provided with a door opening 132 which includes a perimeter door frame 134 connected thereto about the perimeter of the door opening. The perimeter door frame is joined to the tank wall in sealing engagement therewith and includes a bottom sill 136 which is stepped downwardly in relation to a lower most portion of the floor at the bottom end of the tank to ensure that all fluid in the tank is drained downwardly to the perimeter door frame about the door opening. In a closed position, a door panel of the auxiliary door 130 spans across the door opening and is in sealing engagement about the full perimeter of the door opening by fastening with threaded fasteners and suitable sealing gaskets to the perimeter door frame.

An additional access door 138 is provided in the containment side wall 34 at each of the two longitudinally opposed ends of the containment structure for alignment in the longitudinal direction with the auxiliary doors 130 at the outer ends of the tanks respectively. The access door similarly comprises a door panel selectively mounted in sealing engagement with a perimeter about a corresponding door opening in a closed position. The access doors 38 are provided in alignment with the auxiliary doors in the tanks to provide access for an elongate stinger rod therethrough when performing various tank operations.

The secondary containment structure is provided with four suction tubes 140 located at the four corners of floor panel 14. Each suction tube is an elongate pipe which spans between a bottom end in communication with the interior of the containment structure adjacent the floor panel and a top end located above the side walls 34. The top end includes a suitable coupling mounted thereon for connection to transfer hoses of a transfer pump for example. Each suction tube is supported on the adjacent portion of the side walls 34. A sump well 142 is formed in the floor panel in the form of a recessed receptacle extending downwardly relative to the surface of the floor panel in alignment with the bottom end of each suction tube. The bottom end of each suction tube thus extends down in elevation below the upper surface of the floor into the respective sump well to ensure that any fluids collected in the secondary containment structure are drained to the respective sump wells which are in turn in communication with the suction tubes for pumping the fluid back into a tank for recovery as may be desired.

Each tank is provided with additional communication ports which are particularly suited for use of the dual tank structure for receiving produced fluids from a well at a well site. More particularly a production inlet port 144 is provided through the cylindrical wall of the first tank adjacent the outer end thereof at an intermediate portion along a height of the tank corresponding to a location which is just above the height of the side walls 34 of the secondary containment structure. The production inlet 144 comprises a pipe section which is in open communication with the interior of the tank but which includes a suitable coupling at the outer end thereof such as a pipe flange for attaching a production line to receive produced fluids from the well therethrough. The produced fluids thus enter the first tank adjacent the outer end at a longitudinally opposed location from the riser 54 located adjacent the inner end to provide some settling time for the fluids prior to reaching the riser tube.

The riser tube communicates with the external piping 56 defining the passageway 52 through the cylindrical wall of the first and second tanks adjacent the inner ends of both the first and second tanks at a similar elevation as the production inlet so as to be located slightly above the top end of the side walls 34 of the containment structure for ready access.

An additional auxiliary outlet 146 is provided through the cylindrical wall of the first tank adjacent the inner end thereof so as to be located in proximity to the location where the external piping 56 of the passageway 52 communicates out of the first tank.

The external piping 56 of the passage way extends through the cylindrical wall of the second tank adjacent the inner end thereof at the same elevation just above the side walls of the containment structure. An auxiliary inlet coupling 148 also communicates through the cylindrical wall of the second tank adjacent to the external piping 56 at the inner end at the same elevation just above the side wall of the containment structure.

The second tank also includes an auxiliary delivery outlet 150 communicating through the cylindrical wall of the second tank adjacent the outer end thereof at the same elevation above the side wall of the containment structure.

The outlet 146 of the first tank and either one of the auxiliary inlet 148 or auxiliary delivery outlet 150 of the second tank may be used for connection in series with adjacent dual tank structures with additional piping communicating between the adjacent tank structures in series. All of the inlets and outlets include suitable pipe couplings such as a bolt flange permitting the respective port to be blocked if desired or connected to piping if desired. In either instance the pipe connections are all located within the perimeter of the side wall of the secondary containment structure.

When used for production at a well site, the integrally supported dual tank structure 10 described herein permits an operator to simply deliver the structure 10 the site with the plumbing for the various components in the enclosures 44 already being plumbed and operational prior to delivery. Similarly the plumbing providing the passageway 52 between the first and second tanks is already plumbed prior to delivery. The set up at the well site thus only includes pivoting the railing structures into their working position, positioning the portable ladder structures 124, and connecting production lines to the production inlet 144 of the first tank.

Produced fluids can be directed into the first tank where treatment can occur, for example by injecting treatment chemicals through the lines located at the enclosure 44. Treatment can also occur by locating a fire tube assembly within the fire tube opening of the first tank for heat treating the produced fluids in the first tank to encourage separation and better encourage lighter fractions to rise to the top of the first tank for spilling into the riser for transferring to the second tank. An additional fire tube assembly may be mounted in the second tank if desired and additional chemical treatments can also be performed in the second tank if desired. Treated production fluids can then be transferred directly to auxiliary tanks such as a delivery truck by connecting suitable transfer lines between the truck and the components of the enclosure 44 of the second tank. Pivoting the platform 112 into the working position permits a user to access the outlets 104 and connect the transfer hoses such that the connection of the transfer hoses remains within the perimeter of the secondary containment structure as well as all additional pipe connections related to production onsite.

When a site is no longer required for production, the various components of the tank structure 10 are returned to their transport position such that the entire assembly can be again mounted onto a transfer vehicle, for example a winch truck, for transfer to a subsequent well site.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method of preparing a well at an oilfield site for producing hydrocarbons from the well, the method comprising:

(i) providing a dual tank structure comprising:

a base frame which is elongate in a longitudinal direction and which is adapted at a bottom side to facilitate handling and transport of the dual tank structure;

a common containment structure integrally supported on the base frame comprising a floor panel joined to the base frame so as to span in the longitudinal direction and a plurality of side walls extending upwardly from the floor panel about a full perimeter of the floor panel so as to define a containment volume for containing liquid therein;

a first tank integrally supported on the floor panel on the base frame within a perimeter boundary of the floor panel of the common containment structure and which includes a cylindrical side wall extending in the longitudinal direction of the base frame between an inner end wall defining an inner end of the first tank and an outer end wall defining an outer end of the first tank;

the first tank being adapted to receive the produced hydrocarbon fluids from the oilfield site therein;

a second tank integrally supported on the floor panel on the base frame within the perimeter boundary of the floor panel of the common containment structure with the first tank and which includes a cylindrical side wall extending in the longitudinal direction of the base frame between an inner end wall defining an inner end of the second tank and an outer end wall defining an outer end of the second tank;

the cylindrical side wall of the first tank and the cylindrical side wall of the second tank being longitudinally joined end to end in fixed relation to one another such that the inner ends of first and second tanks are adjacent to one another and such that an interior of the first tank and an interior of the second tank are separated from one another by a space between the inner end walls;

the containment volume of the common containment structure being greater than a storage volume of a largest one of the first tank and the second tank;

a passageway extending between a first end of the passageway communicating with the first tank and a second end of the passageway communicating with the second tank so as to be adapted to transfer separated lighter portions of the produced hydrocarbon fluids from the first tank to the second tank;

the passageway being contained within the perimeter boundary of the floor panel of the common containment structure; and a shut-off valve connected in series with the passageway so as to be contained within the perimeter boundary of the floor panel of the common containment structure and so as to be accessible externally of the common containment structure;

the shut-off valve being operable between an open position and a closed position so as to maintain separation between the first tank and the second tank in the closed position; and (ii) transporting dual tank structure as an integral structure including the common containment structure, the first tank, and the second tank, and the passageway joined between the first tank and the second tank, using a single truck.

2. The method according to claim 1 further comprising providing at least one suction tube extending between an open bottom end in communication with the containment structure adjacent a bottom end thereof and an opposing end having a tubing connector thereon for selective connection to a suction pump.

3. The method according to claim 2 wherein said at least one suction tube is received within a sump area recessed below the floor panel of the containment structure.

4. The method according to claim 1 wherein at least one of the tanks comprises a perimeter door frame about an inlet door opening at one end thereof and a door which is movable between a closed position in sealed connection with the perimeter door frame and an open position in which the inlet door opening is substantially unobstructed by the door, the perimeter door frame including a door sill which is recessed below a tank floor defining a bottom end of the tank.

5. The method according to claim 1 wherein there is provided a support structure supported on at least one of the first and second tanks, the support structure comprising:

a platform structure supported above the tanks for supporting a person thereon in proximity to a hatch opening on a top side of one of the tanks;

a ladder structure extending downwardly from the platform for providing access to the platform; and a railing structure extending upwardly from at least one side of the platform structure;

wherein at least one of the platform structure, the ladder structure and the railing structure are foldable from a working position to a transport position in which an overall height of the support structure is reduced relative to the working position.

6. The method according to claim 5 wherein the railing structure is foldable relative to the platform structure from the working position to the transport position to reduce the overall height of the support structure.

7. The method according to claim 1 further comprising:

providing a common containment structure integrally supported on the base frame below both the first and second tanks and having a plurality of side walls extending upwardly to an open top end of the containment structure; and providing a portable ladder structure comprising an upper hook portion arranged to be hooked overtop of a top end of one of the side wall and a depending ladder portion having a plurality of vertically spaced apart rungs formed thereon, the upper hook portion being arranged to be releasably hooked onto the side wall in a first orientation in which the ladder portion extends along an inner side of the side wall and a second orientation in which the ladder portion extends along an outer side of the side wall.

8. The method according to claim 1 wherein the production inlet, the passageway and the delivery outlet are all supported within a perimeter of the containment structure.

9. The method according to claim 8 wherein at least one of the first and second tanks further comprises an enclosure supported adjacent to the tank which locates a plurality of access ports therein in communication with an interior of the tank at different elevations, the enclosure being supported within a perimeter of the containment structure.

10. The method according to claim 9 wherein there is provided an enclosure associated with each of the first and second tanks adjacent respective inner ends of the tanks such that the enclosures are adjacent one another.

11. The method according to claim 1 including providing a platform structure mounted on the base frame in proximity to the delivery outlet for pivotal movement between a working position in which the platform is horizontally oriented for supporting a user thereon and a stored position in which the platform is oriented in an upright orientation.

12. The method according to claim 1 further comprising providing a wash assembly comprising:

a plurality of wash nozzles supported within the first tank;

a supply connection in communication with the wash nozzles for supplying wash fluid therethrough;

a drain connection in communication with the first tank for draining contents of the first tank therethrough;

the supply connection and the drain connection being supported within a perimeter of the containment structure.

13. The method according to claim 1 further comprising providing a fire tube opening in an end wall of at least one of the first and second tanks and a fire tube assembly arranged to be supported in the fire tube opening, the fire tube assembly comprising:

a mounting panel arranged to span the fire tube opening be selectively mounted in sealing engagement about a perimeter of the fire tube opening using threaded fasteners;

a burner fitting in communication through the mounting panel;

an exhaust stack in communication through the mounting panel separately from the burning fitting; and a fire tube having an intermediate portion arranged to extend into the tank in communication between the burner fitting at one end of the fire tube and the exhaust stack at the other end of the fire tube.

14. The method according to claim 1 further comprising:

providing an access door in a side wall of at least one of the tanks; and providing an auxiliary door in a side wall of the containment structure in alignment with said access door so as to be arranged to receive a stinger rod therethrough.

15. The method according to claim 1 wherein the common containment structure has a containment volume which is less than a combined storage volume of both the first tank and the second tank.

16. The method according to claim 1 including locating the passageway so as to be arranged to draw the portion of the produced hydrocarbons from the first tank from a location adjacent a top end of the first tank such that said portion comprises a lighter portion of the hydrocarbons.

17. A method of preparing a well at an oilfield site for producing hydrocarbons from the well, the method comprising:

(i) providing a dual tank structure comprising:

a base frame which is elongate in a longitudinal direction and which includes at least two beams extending in the longitudinal direction along a bottom side of the base frame so as to be arranged to facilitate handling and transport of the dual tank structure;

a common containment structure integrally supported on the base frame comprising a floor panel joined to the at least two beams so as to span in the longitudinal direction and a plurality of side walls extending upwardly from the floor panel about a full perimeter of the floor panel;

a first tank integrally supported on the floor panel on the base frame within a perimeter boundary of the floor panel of the common containment structure and which includes a side wall extending in the longitudinal direction of the base frame between an inner end wall defining an inner end of the first tank and an outer end wall defining an outer end of the first tank;

the first tank being adapted to receive the produced hydrocarbon fluids from the oilfield site therein;

a second tank integrally supported on the floor panel on the base frame within the perimeter boundary of the floor panel of the common containment structure with the first tank and which includes a side wall extending in the longitudinal direction of the base frame between an inner end wall defining an inner end of the second tank and an outer end wall defining an outer end of the second tank;

the side wall of the first tank and the side wall of the second tank being joined in fixed relation to one another such that the inner ends of first and second tanks are longitudinally in series with one another and such that an interior of the first tank and an interior of the second tank are separated from one another by a space between the inner end walls;

the common containment structure having a containment volume which is greater than a storage volume of a largest one of the first tank and the second tank and which is less than a combined storage volume of both the first tank and the second tank;

a passageway which extends between a first end communicating with the first tank adjacent a top end of the first tank and a second end communicating with the second tank, the passageway only communicating with the first tank adjacent the top end of the first tank so as to be adapted to transfer separated lighter portions of the produced hydrocarbon fluids from the first tank to the second tank;

the passageway extending through the side wall of the first tank and through the side wall of the second tank so as to include an external portion which is external of the first tank and the second tank and which is contained within the perimeter boundary of the floor panel of the common containment structure; and a shut-off valve connected in series with the external portion of the passageway so as to be located externally of the first tank and the second tank and so as to be contained within the perimeter boundary of the floor panel of the common containment structure and so as to be accessible externally of the common containment structure;

the shut-off valve being operable between an open position and a closed position so as to maintain separation between the first tank and the second tank; and (ii) transporting dual tank structure as an integral structure including the common containment structure, the first tank, and the second tank, and the passageway joined in fixed relation, using a single truck.

* * * * *